US005160287A

United States Patent [19]

Hirasawa

[11] Patent Number: 5,160,287

[45] Date of Patent: Nov. 3, 1992

[54] COLOR PICTURE TUBE MANUFACTURING METHOD

[75] Inventor: Shigemi Hirasawa, Chiba, Japan

[73] Assignee: Hitachi, Ltd., Tokyo, Japan

[21] Appl. No.: 398,954

[22] Filed: Aug. 28, 1989

[30] Foreign Application Priority Data

Sep. 9, 1988 [JP] Japan ..... 63-224603

[51] Int. Cl.[5] ..... H01J 9/385; H01J 9/26

[52] U.S. Cl. ..... 445/40; 445/42; 445/45

[58] Field of Search ..... 445/45, 73, 70, 38–43, 445/56, 57; 65/34, 43

[56] References Cited

U.S. PATENT DOCUMENTS

| | | | |
|---|---|---|---|
| 2,871,086 | 1/1959 | Korner et al. | 445/40 |
| 3,536,462 | 10/1970 | Eyster et al. | 445/42 X |
| 3,932,011 | 1/1976 | Piascinski | 445/38 |
| 4,073,558 | 2/1978 | Benda et al. | 445/40 |
| 4,213,663 | 7/1980 | Nubani et al. | 445/40 |
| 4,923,423 | 5/1990 | Stockdale et al. | 445/40 |

*Primary Examiner*—Kenneth J. Ramsey

*Attorney, Agent, or Firm*—Antonelli, Terry Stout & Kraus

[57] ABSTRACT

To improve the conventional manufacturing method for a color picture tube in which (1) the panel with a phosphor screen is provided with a shadow mask and baked, (2) the panel and funnel having the necessary parts mounted in the tube, are sealed with frit glass (3) an electron gun is mounted at the main sealing step, and (4) gases are exhausted from the tube, the invention includes a vacuum treatment step which is further provided to exhaust gases from the tube before the temperature in the tube is reduced to the room temperature after the panel and funnel are sealed with frit glass. The vacuum treatment step after the frit sealing step provides a color picture tube with a long life, in which the amount of remaining moisture in the tube is reduced to less than ½ of the conventional one and the gas evolution amount during operation is extremely reduced.

10 Claims, 3 Drawing Sheets

COLOR PICTURE TUBE MANUFACTURING METHOD

BACKGROUND OF THE INVENTION

The present invention relates to a manufacturing method for a color picture tube which has a long life and is highly reliable because gases evolved from each part, even in a large tube during operation are decreased in quantity and the electron emissivity is left unchanged over a long period.

The color picture tube is usually equipped with a phosphor screen on the internal panel surface, internal conductive coating on the internal funnel surface, a shadow mask, an inner shield, an electron shield, and electron gun electrodes in the glass tube. During an exhaustion step or on operation, unnecessary and harmful gases are evolved from the surface of each part mentioned above, resulting in a reduction in the electron emission characteristics of the cathode and in the life span. The phosphor screen evolves structurally a large quantity of gases; consequently, the panel is subjected to the so-called panel baking for out-gassing before the panel and the funnel are subject to frit-sealing. Iron parts including the shadow mask are coated with a corrosion preventing black film comprising of ferrosoferric oxide on each surface. The inner shield is made of an iron plate which is formed with an aluminum film containing silicon on its surface to prevent scattering of impinged electrons and gas evolution, and which is heated in a vacuum to form a black film. This is indicated in Japanese Patent Laid-Open 126524/1987. The electron shield is usually made of aluminum and subjected to corrosion preventing treatment with an oxide film on its surface. The purpose of the corrosion preventing treatment for the surface of each metallic part mentioned above is to prevent each bare surface in the atmosphere from chemical changes such as excessive oxidation which may cause gas evolution during the exhaustion step or on operation.

It goes without saying that gas evolution on operation is undesirable. In addition, at the exhaustion step to be executed after the sealing step for the stem to support each electron gun, gases evolved from the parts in the tube are not always discharged from the tube but a part of them is re-adsorbed in the tube; consequently, excessive gas evolution at the exhaustion step is undesirable. A part of gases evolved from the shadow mask, for example, may be re-adsorbed into the inner shield, the internal graphite coating or the like before the gases are discharged out of the tube and may remain in the tube finally.

To reduce the gas evolution at the exhaustion step and on operation, various countermeasures including complicated ones depending on the treatment process have been taken for the parts in each color picture tube. However, there is recently an increasing demand for large tubes, and the reduction of gas evolution is a more important problem. This is because the gas evolution amount increases as the surface area of each part increases. The conventional countermeasure for such a status is to increase the getter yield. Increasing the getter yield in correspondence with the large size of tubes causes however an undesirable increase in stray electron emission or in the total weight of the getter including the container.

SUMMARY OF THE INVENTION

The object of the present invention is to solve the problems mentioned above and to provide a manufacturing method for a color picture tube with a long life, which reduces gas evolution from each part in the tube on operation and decreases the changes in the emission characteristics with time.

In the conventional manufacturing method for a color picture tube comprising: i) a baking step to bake the panel of each tube in air having a phosphor screen formed on its inner surface and a shadow mask mounted on it, in the atmosphere, ii) frit sealing step to assemble the panel and funnel with all the parts to be mounted in the tube except the electron gun and to heat the panel and funnel to seal the two by melting and crystallizing the solder glass having a low melting point (the so-called frit glass), which is coated and intervened at the junction of the two, iii) the main sealing step to seal the stem to support the electron gun, and iv) the exhaustion step to highly evacuate the tube finally; the present invention provides in order to achieve the object mentioned above, a new step, that is, ii') a vacuum treatment step between steps ii) and iii) to exhaust gases from the space in the tube enclosed by the panel and funnel, before all the parts in the tube are cooled to room temperature and preferably 40° C., after the end of step ii).

The panel with a phosphor screen formed on its inner surface, which is to be baked at the step i), is usually provided with a metal backing film. The funnel, which is to be sealed employing frit glass at step ii), is usually provided with internal conductive coatings. The ultimate vacuum degree (denoted by gas pressure) in the tube at the vacuum treatment at step ii') is $10^{-2}$ to 5 Torr, though the vacuum may be higher (namely the gas pressure may be lower). When the vacuum degree denoted by gas pressure is higher than 5 Torr, the present invention produces little effect. The ultimate vacuum of commercial widely used vacuum equipment, such as a rotary pump, is approximately $10^{-2}$ to $10^{-3}$ Torr, and the general upper limit of the vacuum is $10^{-2}$ Torr. Gases to be exhausted at step ii') are mainly those evolved at the frit sealing in step ii). It is recommended the vacuum treatment in step ii') be done as soon as possible after end of step ii).

The time required for the parts in the tube to be cooled to 40° C. after the end of step ii) can be measured under the manufacturing conditions. After the measurement, the measured time can be used for the vacuum treatment in step ii'). If the temperature of each part in the tube decreases to less than 40° C. before the vacuum treatment in step ii') is finished, it is recommended to heat and hold the parts at more than 40° C. The frit sealing temperature in step ii) is generally higher than 400° C. or often between 430° C. and 460° C. on the current technological level. As a result, the vacuum treatment temperature in step ii') ranges from 460° C. to 40° C. on the current technological level. However, there is no need to put an upper limit to the vacuum treatment temperature, and the actual frit sealing temperature may be used as an upper limit of the vacuum treatment temperature.

When the panel with a phosphor screen formed on its inner surface and with the shadow mask, which are assembled, is subjected to panel baking, aqueous vapor and other gases are evolved in great volume from the parts in the tube, especially from the phosphor screen. The panel baking is performed in the open state, so that most of them are diffused into the atmosphere. However, gases evolved from the parts in the tube during frit sealing are hardly diffused into the atmosphere through a narrow neck tube. The aqueous vapor, which occupies a rather high ratio in the evolved gases, is almost left gaseous in the tube when the temperature of each part in the tube is higher than the normal temperature (which is the normal temperature in the manufacturing process of color picture tubes or the room temperature near the exit of the baking furnace, generally 25+15° C.) by 30° to 50° C. (the temperature of each part is about 40° C.). When the temperature in the tube lowers to the room temperature, the aqueous vapor is changed to moisture which is adsorbed and condensed to dewdrops on the surface of each part in the tube. Sometimes, the moisture may be chemically reacted with each part such as metal surfaces under corrosion preventing films, which are not always perfect, on some metal parts. For example, moisture is adsorbed into the coarse surface of the ferrosoferric oxide film on the surface of each iron plate such as the shadow mask, or into the surface of each ferric oxide film on some parts, or into the aluminum oxide film on each aluminum surface such as the electron shield. And, a part of it is to form in as crystal water. Such moisture cannot be exhausted completely at the heating and exhaustion step in a comparatively short time. Moisture adsorbed into the surface of each part and reaction products are mainly sputtered by impinged electrons on operation instead of by temperature rise, causing decay in the electron emission characteristics of the cathode. The present invention exhausts gases from the tube by the vacuum treatment, when the evolved moisture is left in gaseous state and before a part of it is condensed to dewdrops or chemically adsorbed into the surface of each part, to remove most of the moisture in the state of aqueous vapor. By doing this, most of the remaining gases can be exhausted comparatively simply at the high vacuum exhaustion step after the main sealing step, and the amount of gases evolved in the tube on operation can be minimized. The vacuum treatment, as mentioned above, is done at a temperature higher than 40° C., but, in most cases, it is generally done at 50° to 60° C.

At the exhaustion step for color picture tubes, it is easy to exhaust gaseous substances from each tube at first, while it is difficult to remove gases physically or chemically adsorbed into the surface of each part in the tube as the vacuum in the tube increases. In the case of an exhauster to be used for mass production of color picture tubes, the ultimate vacuum in each tube ranges from $10^{-5}$ to $10^{-6}$ Torr at highest.

DESCRIPTION OF THE PREFERRED EMBODIMENTS

Figure 2:
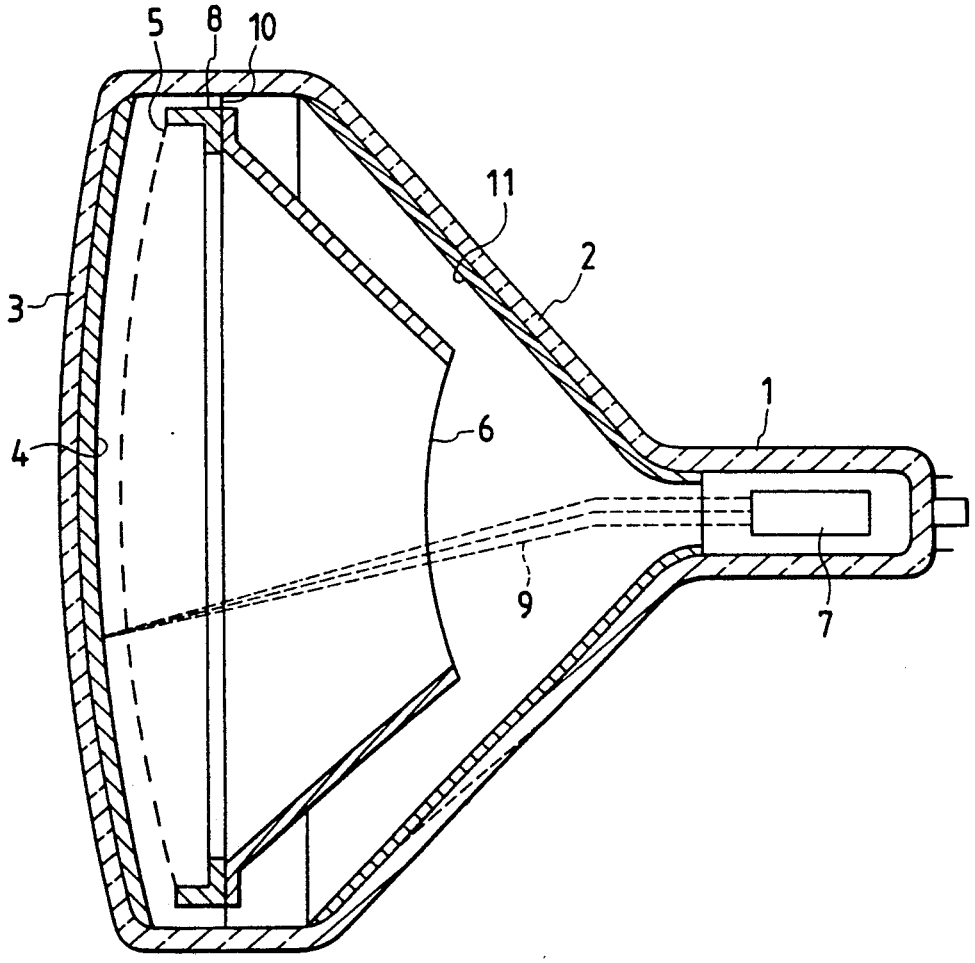
FIG. 2 is a sectional diagram of a color picture tube.

FIG. 2 shows a sectional diagram of a color picture tube. In the figure, reference numeral 1 designates a neck tube, 2 a funnel, 3 a panel, 4 a phosphor screen, 5 a shadow mask, 6 an inner shield, 7 an electron gun, 8 a shadow mask support frame, 9 an electron beam, 10 an electron shield, and 11 an internal graphite coating used as an internal conductive film. The shadow mask, support frame, and inner shield are made of soft iron plates, and the electron shield and the metal backing film on the back of the phosphor screen, which is not shown in the figure, are made of aluminum. The surface of each solid part mentioned above is apt to adsorb moisture with which the tube is filled after the frit sealing step.

Descriptions of the manufacturing process for a color picture tube of this embodiment follow.

A phosphor screen is formed on the inner surface of the panel, aluminum is deposited on it to form a metal backing film, then a shadow mask is mounted on it. The panel is baked in the atmosphere to evolve gases.

An internal graphite coating is formed on the inner surface of the funnel.

All the parts except the electron gun, which are to be contained in the glass bulb, are mounted on the panel and funnel mentioned above. The panel and funnel are heated and sealed with frit glass with the parts contained.

Figure 1:
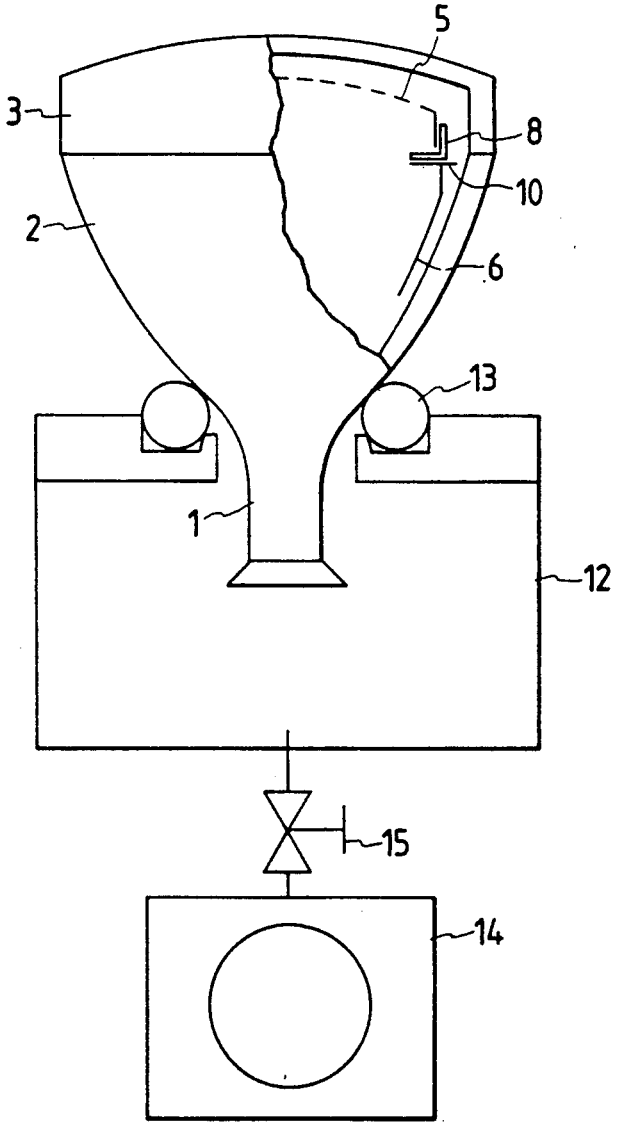
FIG. 1 is a schematic diagram showing the vacuum treatment step after the frit sealing step of an embodiment of the present invention.

During the time that the temperature of the glass bulb consisting of the panel and funnel, which are sealed with frit glass with the parts contained, decreases from the high frit sealing temperature to the normal temperature, gases are exhausted from the tube by the vacuum treatment. The vacuum treatment is performed when the temperature of each part in the glass bulb is about 55° C. As shown in FIG. 1, the glass bulb consisting of panel 3 and funnel 2, which contain the parts, is mounted on frame 12 via rubber packing 13. The vacuum treatment exhausts gases from the bulb with rotary pump 14, whose ultimate vacuum is about $10^{-2}$ Torr In FIG. 1, reference numeral 15 designates a vacuum valve, and the other numerals designate the same as those in FIG. 2.

After the main sealing step is performed for supporting the electron gun in the glass bulb, gases are exhausted from the bulb to make it highly evacuated. By doing this, a color picture tube has been obtained in this embodiment.

In the present invention, as mentioned above, moisture filled in the picture tube is removed immediately after the frit sealing. Therefore, the invention provides a color picture tube with a long life, in which the amount of remaining gases (mainly moisture) is decreased and the change (decay) in the electron emission characteristics with time is minimized unlike a conventional tube in which adsorbed gases are heated and removed at the exhaustion step.

Figure 3:
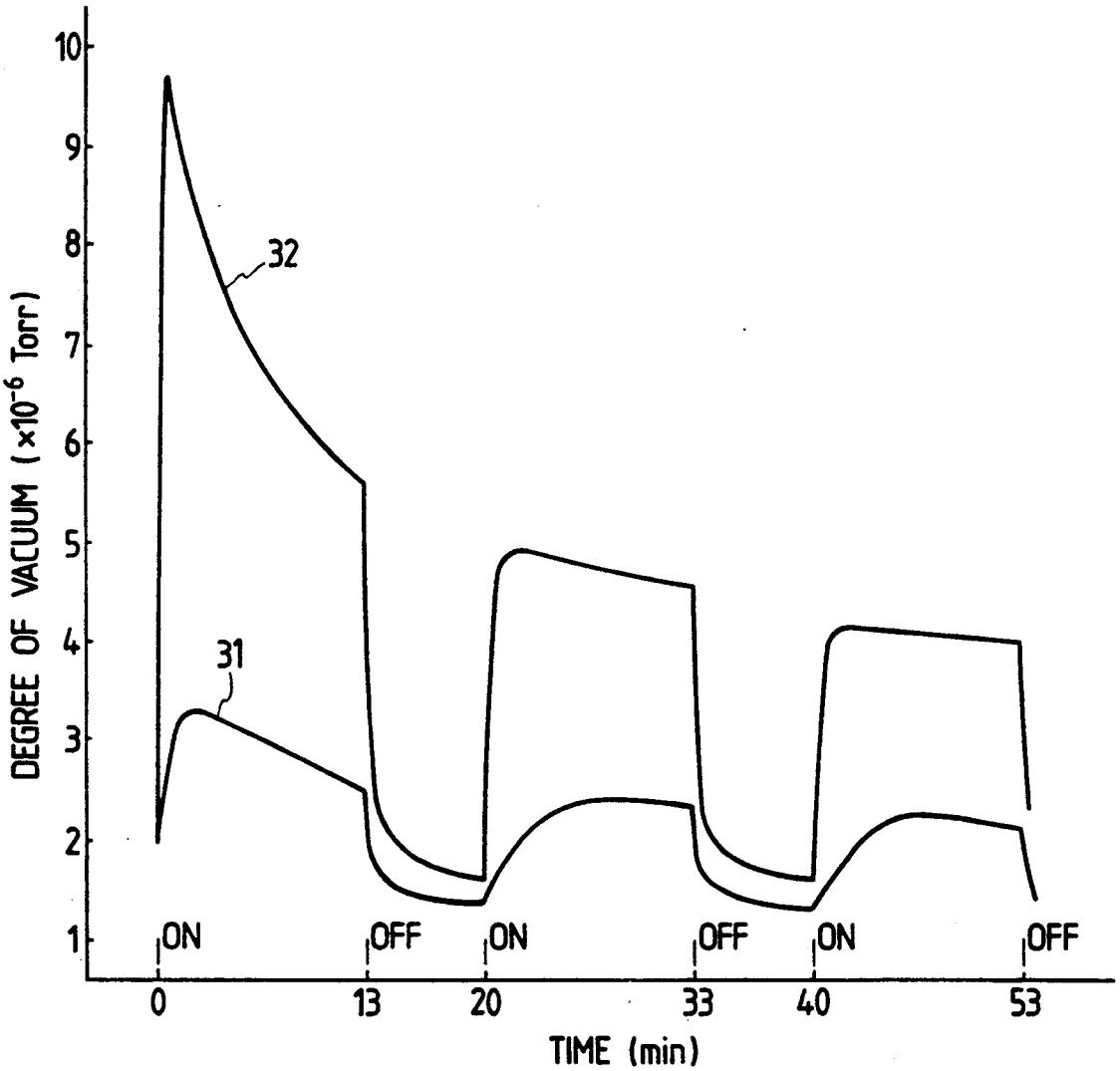
FIG. 3 shows a graph indicating changes in the amount of gases, on operation, in a color picture tube of an embodiment of the present invention and in a color picture tube by the conventional technology.

The change of the degree of vacuum in the color picture tube obtained in this embodiment, which is operated for 13 minutes and stopped for 7 minutes cyclically, has been measured. Curve 31 in FIG. 3 is a curve of vacuum degree vs. time in this embodiment. Curve 32 in the same figure is a curve of vacuum degree vs. time when a color picture tube, which is produced in the same way as the tube mentioned above, except that the vacuum treatment between the frit sealing step and the main sealing step is not conducted, using the conventional manufacturing method, is used.

FIG. 3 shows that the color picture tube of the present invention is decreased in gas evolution amount during operation extremely compared with a conventional tube and the intra-tube gas pressure during operation is reduced to ½ to ⅓ of the conventional one.

As mentioned above, the present invention provides a color picture tube with a long life, in which the amount of lastly remaining moisture in the tube is reduced to less than ½ of the conventional one, the gas evolution amount on operation is reduced, and the decay in the electron emission characteristics with time is extremely minimized.

What is claimed is:

1. In the manufacturing method of a color picture tube comprising i) a frit sealing step to join the panel and funnel having all the necessary parts mounted in the tube, ii) a main sealing step to support the electron gun, and iii) an exhaustion step to evacuate the tube; an improvement in the color picture tube manufacturing method which is featured by further comprising i') a vacuum treatment step provided between the steps I) and ii) to exhaust gases from the space in the tube enclosed by the panel and funnel, before all the parts in the tube are cooled to the room temperature after the end of the step i), whereby said step i') is conducted when said gases are left still in gaseous state and before said gases are condensed to dewdrops or chemically adsorbed into a surface of each part in said tube so that moisture filled in the tube is removed in the state of aqueous vapor and wherein the ultimate vacuum degree, denoted by gas pressure, in the tube at the vacuum treatment step i') is less than 5 Torr.

2. The color picture tube manufacturing method according to claim 1, wherein the ultimate vacuum degree ranges from $10^{-2}$ to 5 Torr.

3. The color picture tube manufacturing method according to claim 1, wherein the temperature in the tube at the vacuum treatment step i') is higher than 40° C.

4. The color picture tube manufacturing method according to claim 1, wherein there is the baking step to bake the panel having a phosphor screen formed on its inner surface and a shadow mask mounted on it, prior to the step i).

5. The color picture tube manufacturing method according to claim 1, wherein the funnel is provided with internal conductive coating on its surface.

6. The color picture tube manufacturing method according to claim 1, wherein the phosphor screen provided with a metal backing film.

7. A method for manufacturing a color picture tube comprising:

providing a panel having a phosphor screen formed on a major surface;

mounting a shadow mask on said panel adjacent said phosphor screen;

baking said panel having said phosphor screen and said shadow mask mounted thereon;

joining a funnel to the baked panel by providing a frit glass therebetween and heating said frit glass to a high frit sealing temperature to melt and crystallize said frit glass;

vacuum treating the joined panel and funnel to exhaust gases from a space in said color picture tube enclosed by said panel and said funnel, wherein said vacuum treating is conducted such that gas pressure within said space is less than 5 Torr and is performed while said joined panel and funnel are at a temperature between said high frit sealing temperature and room temperature; and then supporting and sealing an electron gun on said joined panel and funnel to form a sealed tube; and then evacuating said sealed tube;

whereby said vacuum treating exhausts said gases from said space while said gases are still in a gaseous state and before said gases are condensed to dewdrops or chemically adsorbed into an inner surface of the tube.

8. A method for manufacturing a color picture tube according to claim 7, wherein said high frit sealing temperature is greater than 400° C.

9. A method for manufacturing a color picture tube according to claim 7, wherein said vacuum treating step is performed while said joined panel and funnel is at a temperature higher than 40° C.

10. A method for manufacturing a color picture tube according to claim 7, wherein said vacuum treating step is performed while said joined panel and funnel is at a temperature of 50° to 60° C.

* * * * *